US009251677B1

(12) United States Patent
Mika

(10) Patent No.: US 9,251,677 B1
(45) Date of Patent: Feb. 2, 2016

(54) POWERED ENTRANCE BARRIER ALARM DEVICE AND SYSTEM USING SAME

(71) Applicant: Bart Peter Mika, Avondale, AZ (US)

(72) Inventor: Bart Peter Mika, Avondale, AZ (US)

( * ) Notice: Subject to any disclaimer, the term of this patent is extended or adjusted under 35 U.S.C. 154(b) by 14 days.

(21) Appl. No.: 14/304,779

(22) Filed: Jun. 13, 2014

(51) Int. Cl.
*G08B 13/08* (2006.01)

(52) U.S. Cl.
CPC ..... *G08B 13/08* (2013.01)

(58) Field of Classification Search
CPC ..... G08B 13/08; G07C 9/00309
USPC ..... 340/545.1, 522, 5.7
See application file for complete search history.

(56) References Cited

U.S. PATENT DOCUMENTS

| | | | | |
|---|---|---|---|---|
| 4,074,269 | A | 2/1978 | Hartley | |
| 4,404,558 | A | 9/1983 | Yen | |
| 4,433,274 | A | 2/1984 | Duhame | |
| 4,737,770 | A | 4/1988 | Brunius et al. | |
| 5,444,440 | A | 8/1995 | Heydendahl | |
| 5,731,756 | A | 3/1998 | Roddy | |
| 5,781,107 | A * | 7/1998 | Ji | G08B 13/08 340/522 |
| 6,346,889 | B1 | 2/2002 | Moss | |
| 6,563,278 | B2 | 5/2003 | Roman | |
| 6,563,431 | B1 | 5/2003 | Miller | |
| 6,878,889 | B1 | 4/2005 | Horst et al. | |
| 6,989,760 | B2 * | 1/2006 | Dierking | G07C 9/00309 340/5.7 |
| 2009/0146797 | A1 | 6/2009 | Chiba et al. | |
| 2011/0043328 | A1 | 2/2011 | Bassali | |

* cited by examiner

*Primary Examiner* — Albert Wong
(74) *Attorney, Agent, or Firm* — Invention To Patent Services; Alex Hobson

(57) ABSTRACT

A powered entrance barrier door alarm device and system is configured to alert someone of an unauthorized breach of a powered entrance barrier, such as a garage door, whereby the powered entrance barrier is opened without the use of the powered entrance barrier opener. The powered entrance barrier alarm system includes a powered entrance barrier position sensor, and a detector circuit coupled with a powered entrance barrier opener power supply. The detector circuit measures an electrical power parameter to a powered entrance barrier opener. A detector module having a controller monitors the inputs from the detector circuit and the powered entrance barrier positioning sensor to determine if an alarm should be initiated. A detector module may have an electrical plug and an electrical outlet for a powered entrance barrier opener.

19 Claims, 8 Drawing Sheets

Garage alarm

POWERED ENTRANCE BARRIER ALARM DEVICE AND SYSTEM USING SAME

FIELD OF THE INVENTION

The present invention relates to powered entrance barrier alarm devices and systems for alerting someone of an unauthorized breach of a powered entrance barrier, such as a garage door.

BACKGROUND

Home intrusion is a big concern for many home owners and many take measures to reduce the chance of a break-in of their home. Many homeowners install a home security system that incorporates entry sensors, motion sensors and in some cases video surveillance cameras. Entry sensors mounted to doors and/or windows are configured to detect the opening of the door or window. Entry sensors are often installed on garage doors, as this is a vulnerable point of entry. Garage doors may be forced opened or the locking mechanism may be release thereby allowing entry. Installation of entry sensors on garage doors causes a problem for many home owners that enter the home through the garage regularly. When the garage door is opened and the alarm system is activated, the homeowner must quickly go to the alarm system control unit to deactivate the alarm. A homeowner may have groceries or other items to retrieve from the vehicle before entering the home and this delay may prevent them from reaching the control unit before time expires and the alarm is activated. This can be a real nuisance. When an alarm is activated, a call may be made by the alarm system company or local authorities to confirm that there is no emergency situation. Some alarm systems provide a wireless controller that is configured to remotely activate or deactivate the alarm system. Unfortunately, this is another device that a home owner must keep track of and remember to push when entering through home.

Most home alarm systems are configured with a delay to allow the homeowner to make their way to the alarm system control unit and disable the alarm. This delay can be several minutes which is plenty of time for an intruder to breach a garage door or other powered entrance barrier, load up valuable items, such as bicycles, and leave before the delay expires and the alarm is sounded.

SUMMARY OF THE INVENTION

The invention is directed to powered entrance barrier alarm devices and systems for alerting someone of an unauthorized breach of a powered entrance barrier, such as a garage door. The powered entrance barrier system, as described herein comprises a powered entrance barrier position sensor, and a detector circuit coupled with a powered entrance barrier opener power supply. The detector circuit measures an electrical power parameter (current or voltage) to a powered entrance barrier opener, such as an electrical motor. In an exemplary embodiment, a powered entrance barrier is a garage door and the powered entrance barrier opener is a garage door opener. Another example of a powered entrance barrier is a powered gate that a homeowner may open to enter the property, for example. The powered entrance barrier alarm device is configured, in one embodiment, to signal an alarm if the barrier, garage door or gate, for example, is opened without the use of a powered entrance barrier opener. For example, when a homeowner returns home and they push the remote control garage door opener, electrical power is drawn by the garage door opener and this is measured by the detector circuit. In addition, as the garage door is lifted by the garage door opener, the garage door position sensor relays an up position of the garage door. The garage door alarm system will not activate an alarm in this scenario, as the garage door was opened by the garage door opener. In the event of a forced entry, whereby the garage door position sensor detects that the garage door has been opened but the detector circuit does not detect an allowable power parameter, an alarm will be initiated. An allowable power parameter is a current or voltage that is indicative of the garage door opener opening the garage door. This allowable threshold power parameter may be different for various garage door openers, or other types of powered entrance barrier openers and therefore, in one embodiment, a powered entrance barrier alarm system comprises a threshold power parameter setting feature.

A powered entrance barrier alarm system, as described herein, may comprise any suitable type of alarm, such as an audible and/or visual alarm. An audible or visual alarm may be configured on a detector module, or may be positioned within or on the exterior of the home or dwelling. A visual alarm may be a light, and the light may flash or strobe. An audible alarm may be a siren, horn, voice or speech, or any other suitable audible alarm. In an exemplary embodiment, a powered entrance barrier alarm system is configured to send an alarm notification to a remote party, such as an alarm system company, local authorities, the homeowner, or other authorized person. An alarm notification may be a phone call, text message, or email, for example. The powered entrance barrier alarm system may be configured to send an alarm notification in the event of an unauthorized entry through the powered entrance barrier. An alarm that is activated by the powered entrance barrier alarm system, as described herein, may be part of an existing or secondary home alarm system and the powered entrance barrier alarm system may be coupled with this alarm system, whereby a signal of unauthorized entry is sent from the powered entrance barrier alarm system to the home alarm system. In an exemplary embodiment, a powered entrance barrier alarm system comprises an alarm set-point feature, whereby the alarm may be set to activate and sound immediately or after a delay. In another embodiment, an alarm set-point feature allows a user to select what type of alarm they want initiated, such as audible, visual, and/or notification alarm.

In an exemplary embodiment, a powered entrance barrier alarm system comprises a detector module having a controller that is configured to receive input from a detector circuit and a powered entrance barrier positioning sensor and send an alarm signal if an unauthorized entry is detected. A controller may be any suitable type of controller including a microprocessor or a control circuit. In an exemplary embodiment, a detector module is configured with an electrical plug and an electrical outlet wherein a powered entrance barrier opener may be plugged therein. The power to the powered entrance barrier opener may flow from an outlet, through the detector module electrical plug, to the detector module electrical outlet and finally to the powered entrance barrier opener. In this manner, the power required for the powered entrance barrier opener flows through the detector module. In an exemplary embodiment, a detector circuit is configured within a detector module and measures the power flowing to the powered entrance barrier opener. A detector module may comprise a powered entrance barrier positioning sensor input, wherein a wire from a powered entrance barrier positioning sensor is plugged therein. In another embodiment, a powered entrance barrier positioning sensor is configured to send a wireless signal, and a detector module is configured with a wireless signal receiver. A detector module may be configured with additional electrical outlets.

When a controller, as described herein, receives input from the detector circuit and the powered entrance barrier positioning sensor indicating an unauthorized breach of the powered entrance barrier, an output signal may be initiated by a signal generator. The output signal may travel through a wire, or wirelessly to a home security system, for example. The home security system may be configured to sound an alarm and/or send a notification alarm, as described herein. In another embodiment, a signal generator may send a wireless signal as a notification alarm. It is to be understood that the powered entrance barrier alarm system, as described herein, may be configured as part of a home, dwelling or any other secondary alarm system or as a stand-alone alarm system. A powered entrance barrier alarm system may be coupled with a secondary alarm system or with any other auxiliary system, such as a smart home system through any suitable means, including through a wire, such as an electrical or coaxial wire or cable, wirelessly including Bluetooth, through a WIFI system and the like. Bluetooth, as used herein, is defined as a short range, low power-consuming wireless networking technology that wirelessly interconnects electronic devices.

The powered entrance barrier position sensor may be any suitable type of sensor configured to sense the position of the garage door. In an exemplary embodiment wherein the powered entrance barrier is a garage door, a position sensor may be configured to detect a door locator configured on a garage door. The position sensor may be configured to sense the door locator when the garage door is in a down position and as soon as the garage door is opened, the door locator moves and the position sensor senses that the garage door has been opened, or in an up position. The powered entrance barrier positioning sensor may be configured with a wire for connection with a detector module or it may be configured with a wireless transmitter for detection by a wireless receiver within the detector module. In another embodiment, a garage door position sensor comprises a light beam and a receiver, whereby the light is received by the receiver when the garage door is in a down position, but is broken when the garage door is in an up position. In another exemplary embodiment, a powered entrance barrier is a gate that is configured to allow entrance onto a fenced-in or otherwise barricaded property and a detector module is coupled with a motor configured to open the gate and a positioning sensor configured to detect when the gate is opened, or moved from closed position.

A detector circuit, as described herein, is configured to measure an electrical power parameter to the powered entrance barrier opener, such as voltage and more preferably current. Since powered entrance barrier openers may require different amounts of power and as garage doors and gates come in many different sizes and weights, a threshold power parameter setting feature may be used to set the threshold power parameter required by the powered entrance barrier opener. A detector module may be configured with a dial or knob and a LED light may indicate that a threshold power parameter has been surpassed by the power being drawn by the powered entrance barrier opener. A user may open a powered entrance barrier that is coupled with the detector module, and then turn the dial of the threshold power parameter setting feature until the LED light turns green. The LED indicator light may change from green to red or turn off if the dial is turned too much, whereby the power being drawn by the powered entrance barrier opener does not exceed the threshold power parameter. A user may then watch the indicator light as the garage door finishes opening and see if the light turns off, or changes color to indicate that the power threshold is not being met by the lights of the garage door opener, for example. In the event that the threshold power parameter indicator does not turn off when the powered entrance barrier has finished being lifted or opened, the user may turn the dial up until the indicator turns off. This method will set the threshold power parameter above the power level for powering the lights of the garage door opener, for example, and below the power level required to open the garage door. It is to be understood that a powered entrance gate may also have one or more lights that are configured to turn on when the gate is opened and these lights may receive power through the powered entrance barrier opener. In another embodiment, a user may couple a powered entrance barrier opener to a detector module and simply press a threshold power parameter setting feature, or button, and hold down this button while they open the powered entrance barrier with the powered entrance barrier opener. The controller may automatically set a lower limit of power that has to be detected to signal an authorized entry. In one embodiment, the detector circuit is configured within a garage door opener or other powered entrance barrier opener. In one embodiment, the detector circuit simply detects if current is flowing to the powered entrance barrier opener. In many homes, a garage door opener or other powered entrance barrier opener may be completely off and draw no power until the garage door is opened.

In another exemplary embodiment, a powered entrance barrier alarm system comprises a detector, such as a circuit, that is coupled with a powered entrance barrier opener to measure power being drawn from a battery. Some powered entrance barrier openers are configured with a battery back-up, whereby a person can open the powered entrance barrier with the opener in the event of a power failure.

The powered entrance barrier alarm system may provide a user a method of activating an alarm when a powered entrance barrier is opened without the use of a powered entrance barrier opener. Any of the powered entrance barrier alarm systems as described herein may be coupled with a powered entrance barrier opener, whereby power to the powered entrance barrier opener is monitored by a detector circuit. A powered entrance barrier position sensor may be mounted to detect the opening of the powered entrance barrier. A detector module may be plugged into an electrical outlet to power the powered entrance barrier alarm system. When the powered entrance barrier position sensor detects that the powered entrance barrier has been opened and the detector circuit does not detect a threshold power parameter, an alarm is signaled.

In another embodiment, a detector circuit is configured to measure power drawn by a powered entrance barrier opener but does not physically couple with the opener power supply. There are non-contact methods of measuring the electrical power that is being transferred through a wire or cable and these devices may be used to determine a threshold power parameter, as described herein. A non-contact voltage tester may be used, for example, to determine if power is being drawn by a powered entrance barrier opener. The magnetic field around a wire or cable may also indicate the amount of current running through the cable and this may be correlated to a threshold power parameter metric.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
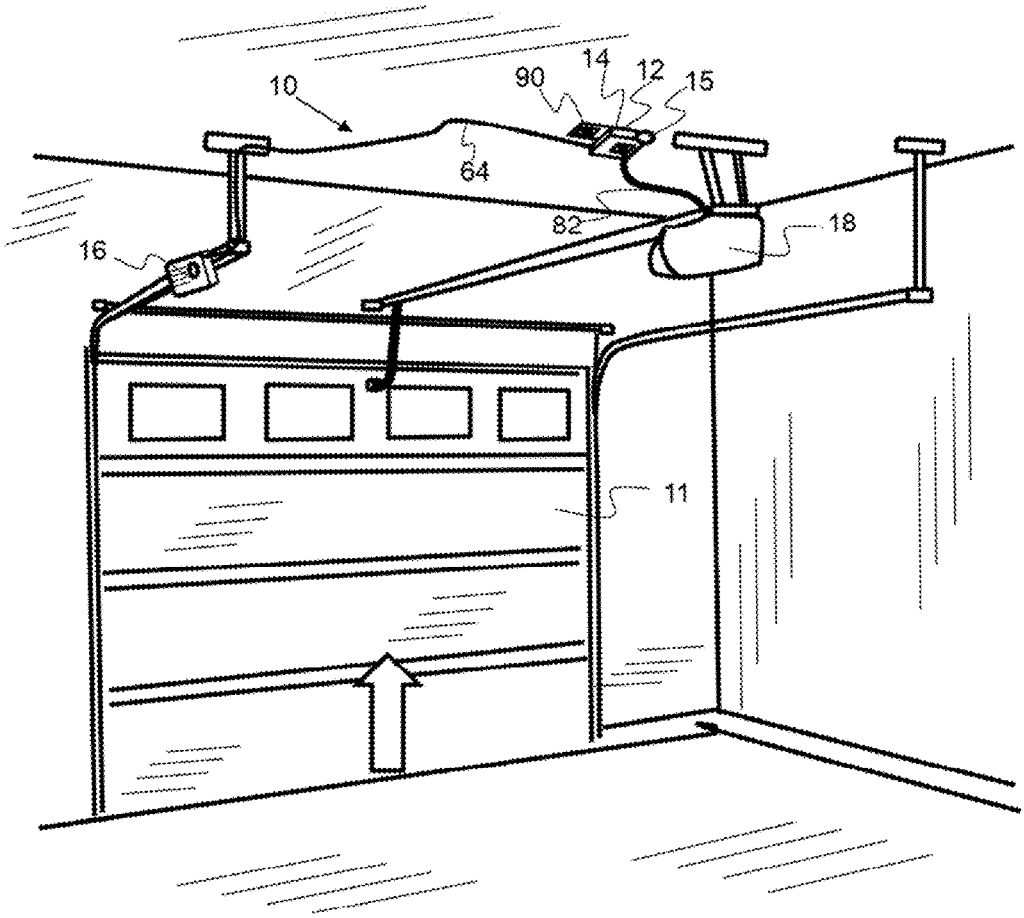

FIG. 1 shows a perspective view of an exemplary garage door alarm system having a detector module plugged into an outlet and a garage door opener plugged into the detector module.

Figure 2:
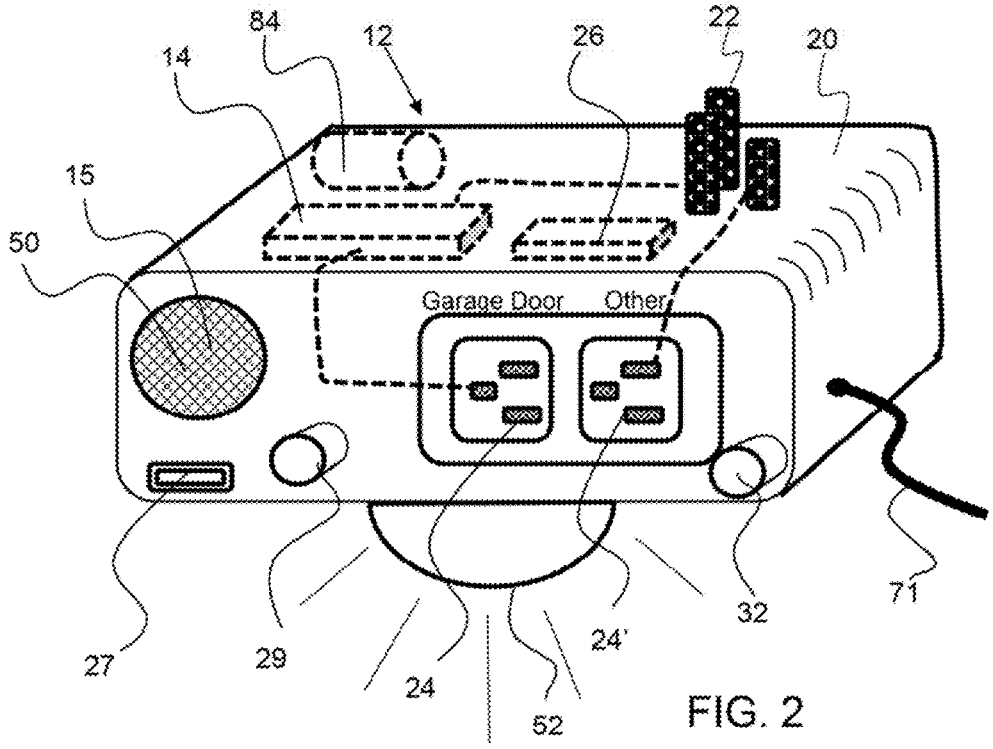

FIG. 2 shows a perspective view of an exemplary detector module having an electrical plug, a plurality of outlets, an alarm, a detector circuit and an output signal feature.

Figure 3:
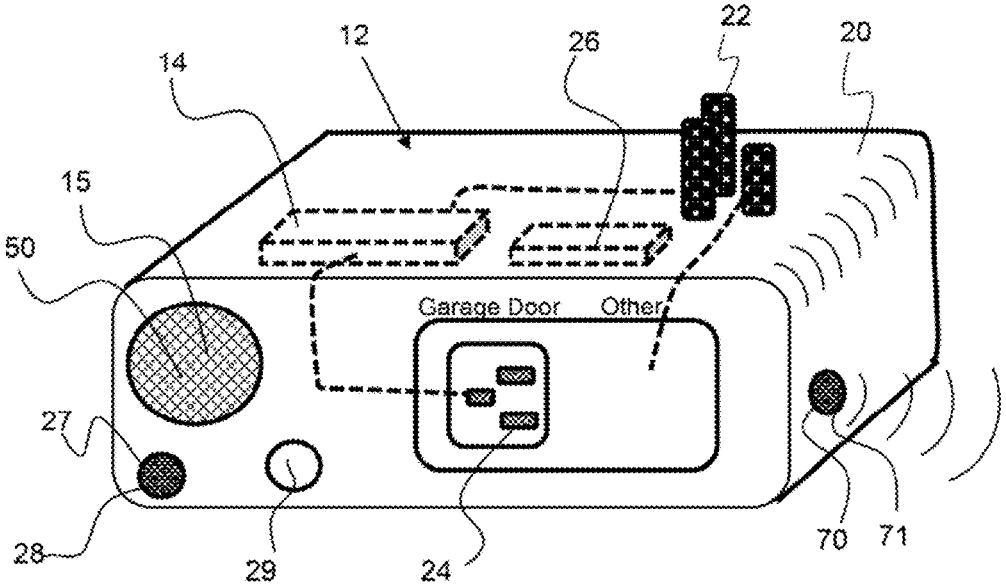

FIG. 3 shows a perspective view of an exemplary detector module having an electrical plug, a plurality of outlets, an alarm, a detector circuit and an output signal feature.

Figure 4:
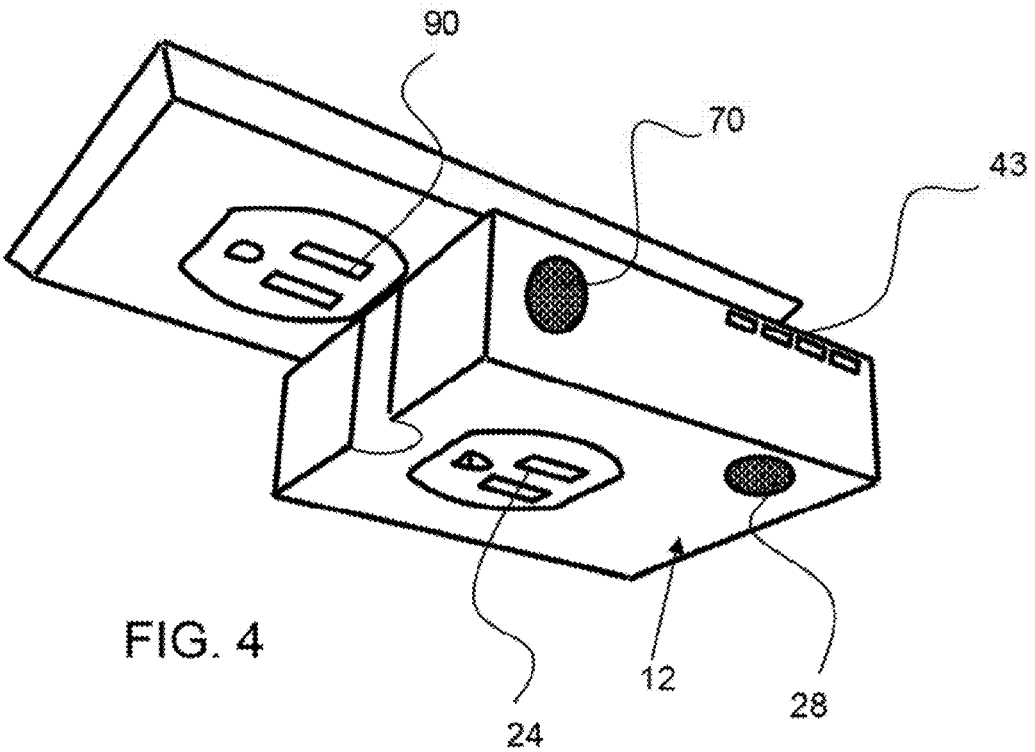

FIG. 4 shows a perspective view of an exemplary detector module having an electrical plug, a single outlet for the powered entrance barrier opener and a wireless signal receiver.

Figure 5:
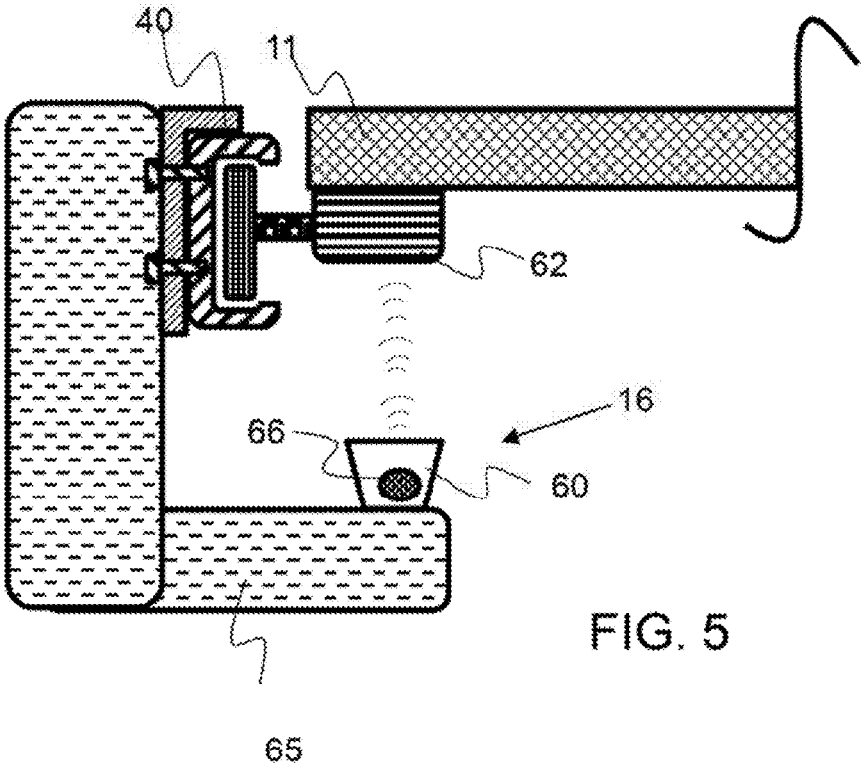

FIG. 5 shows an exemplary garage door positioning sensor.

Figure 6A:
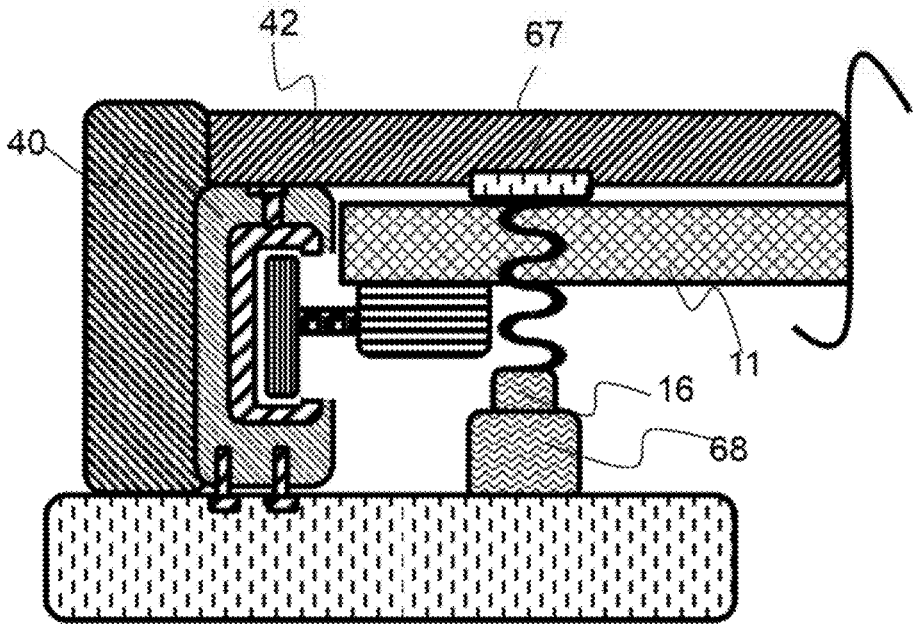

FIG. 6A shows an exemplary light emitting garage door positioning sensor with the garage door in a down position.

Figure 6B:
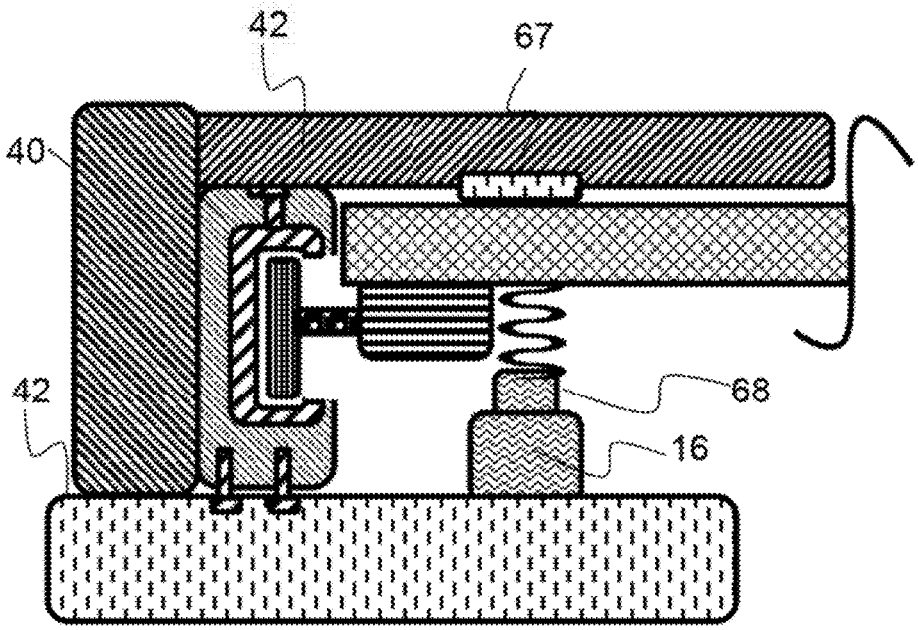

FIG. 6B shows the exemplary light emitting garage door positioning sensor as shown in FIG. 6A with the garage door in an up position.

Figure 7:
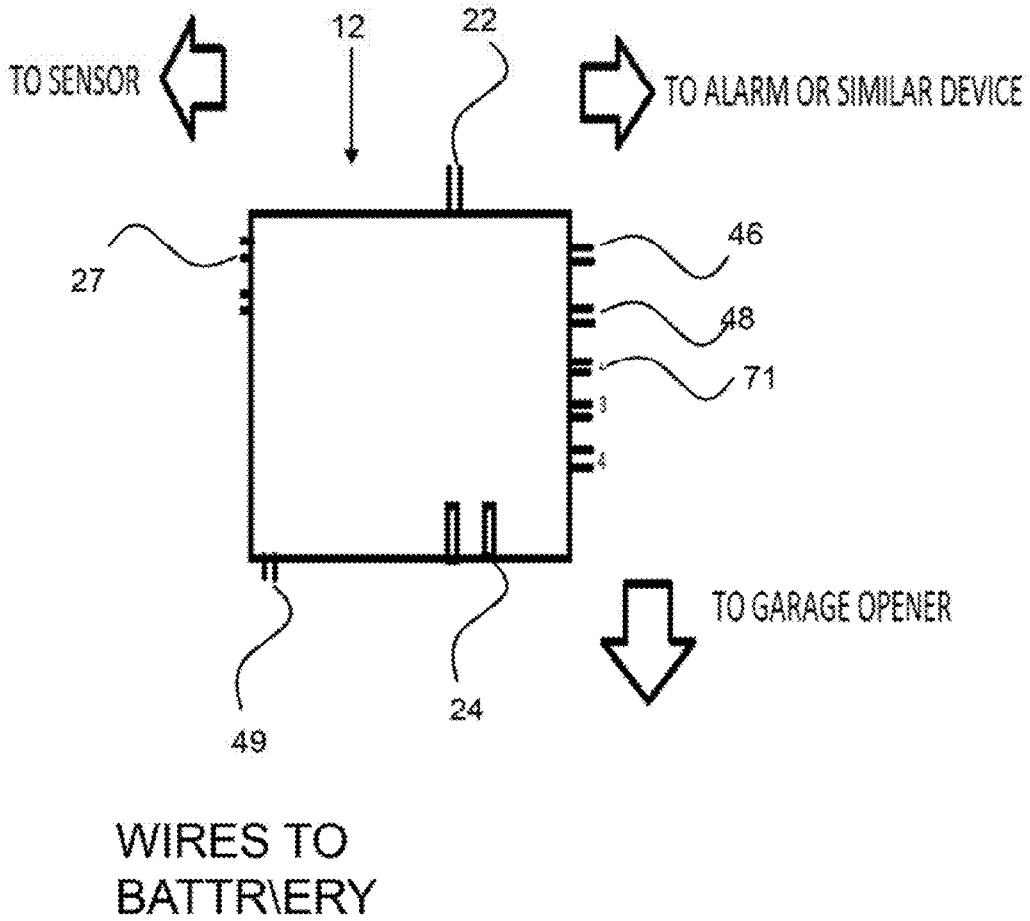

FIG. 7 is an exemplary diagram of the inputs to an exemplary detector module.

Figure 8:
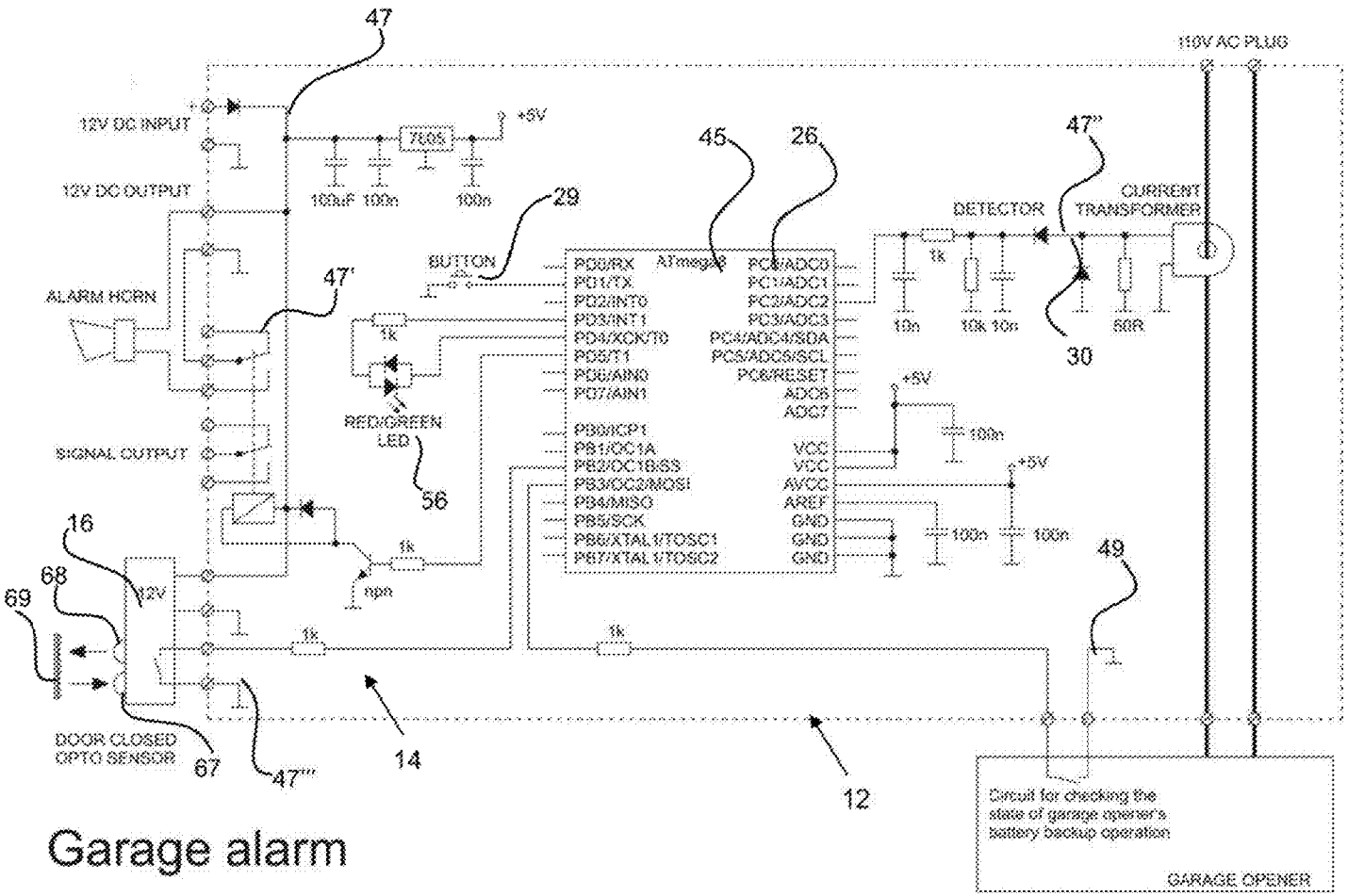

FIG. 8 is an exemplary diagram of an exemplary control circuit.

Figure 9:
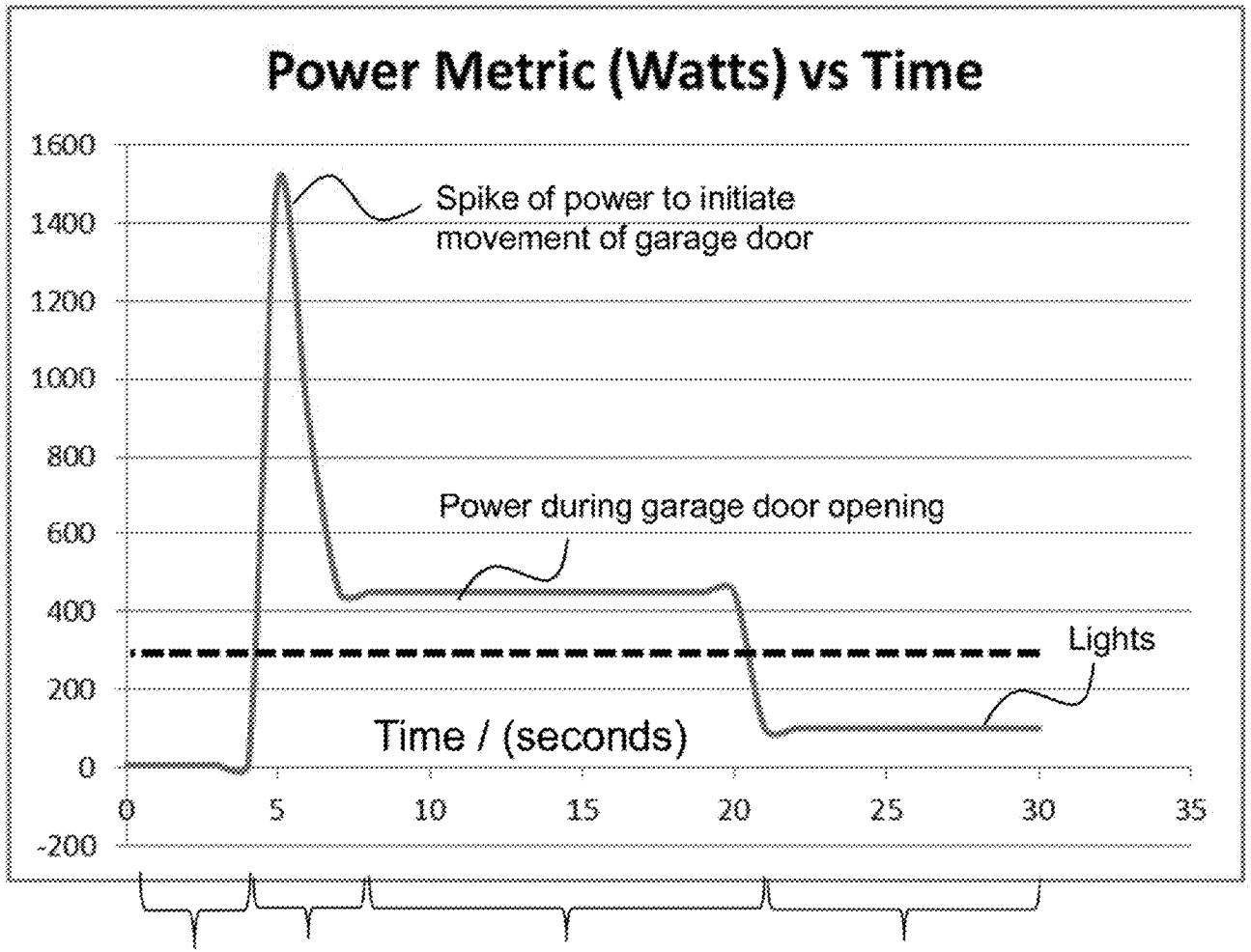

FIG. 9 is an exemplary diagram of a power drawn by a garage door opener when it is activated to open.

Figure 10:
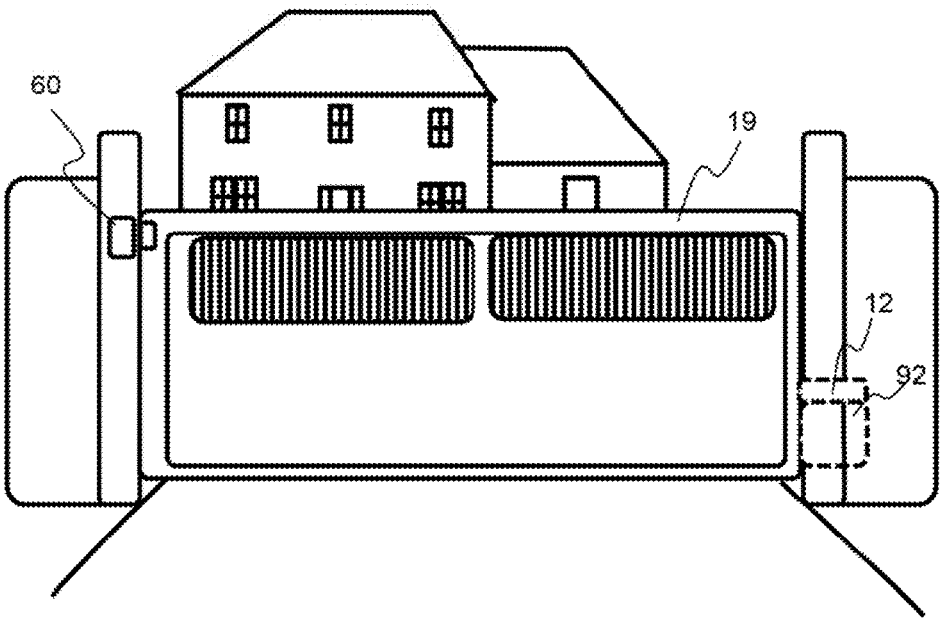

FIG. 10 shows a front entrance view of an exemplary powered entrance barrier that is a gate.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown if FIG. 1, an exemplary powered entrance barrier alarm system 10 has a detector module plugged 12 into a power supply outlet 90 and a garage door opener plugged into the detector module. The detector module comprises a detector circuit that measures the electrical power, electrical current and/or voltage, that is required by the garage door opener. When the garage door opener receives a signal to open, the opener pulls power from the power supply outlet and through the detector module. In normal situations, the detector module receives a signal from a garage door position sensor 16 that the garage door 11 is being opened and the detector circuit 14 measures an electrical power parameter of the power being drawn by the garage door opener. The measured power parameter is compared with threshold power parameter, or limit, and in normal cases is above this threshold value. Therefore, no alarms are initiated. If however, the garage door is forced open, the power parameter measured would be below the threshold limit and an alarm signal would be initiated. As shown in FIG. 1 a garage door position sensor is coupled with the detector module by a connection wire 64. The garage door opener is coupled with the detector module by a power cord 82 and the power cord acts as a power supply conduit to the garage door opener. An outlet may be a power supply that provides power, through a power cord, to a garage door opener, for example. An alarm 15 may be configured on the detector module 12 or configured in any suitable location.

As shown in FIG. 2, an exemplary detector module 12 has a module electrical plug 22, a plurality of module electrical outlets 24, 24', an alarm 15, a detector circuit 14 and a secondary alarm system interface 71. The secondary alarm system interface 71 is a wire that is physically coupled with a secondary alarm system. A detector module may have a controller 26, such as a microprocessor, or in some cases, one or more electrical circuits. The detector module comprises a housing 20 for the electronics and other features. As shown in FIG. 1, a detector module 12 may be plugged into a power supply outlet by the module electric plug 22 and a powered entrance barrier opener can be plugged into a designated powered entrance barrier opener electrical outlet 24. The dashed line illustrates that electrical power may travel from the module electrical plug, through or by the detector circuit, and to the module electrical outlet. A threshold power parameter sensor may also be configured to measure a power being drawn by a powered entrance barrier opener and may comprise a detector circuit. In some cases, only a single outlet is provided. In the case of two or more module electrical outlets, one outlet, 24, may be designated for the powered entrance barrier opener only. The detector module in FIG. 2 has an allowable threshold power parameter setting feature 29, that is dial or knob that can be turned to increase the lower threshold power limit value. Also shown in FIG. 2 is a powered entrance barrier position sensor input 27, wherein a cable or wire from a garage door sensor may be plugged in. There are two alarms 15 that are configured on the detector module, an audible alarm 50 and a visual alarm 52, or light. A battery 84 is shown configured in the detector module that may be used to power the powered entrance barrier alarm system in the event of a power failure. Back-up power to the powered entrance barrier alarm system may also be received from a back-up battery configured with a powered entrance barrier opener. Also shown in FIG. 2. is an alarm set-point feature 32 that enables a user to set the amount of delay time before the alarm will be initiated.

As shown in FIG. 3, an exemplary detector module 12 has an electrical plug 22, a single outlet 24, an alarm 15, a detector circuit 14 and an output signal feature 70. The detector module is also configured with a threshold power parameter setting feature 29 that is a button. As described, a user may press the button while the powered entrance barrier, such as a garage door is being opened by the garage door opener to set the power parameter threshold value. A garage door opener typically runs on a 120V and a 10 or 15 amp circuit and may draw a large amount of power initially, and then settle down to a more consistent power draw of about 400 watts, or 3.3 amps, for example. The threshold current may be set at 2.5 amps automatically by the controller. A threshold power parameter control feature may be automatic, whereby the threshold power parameter level is set automatically by the garage door alarm system. The powered entrance barrier position sensor input 27 is a wireless receiver 28, as shown in FIG. 3.

As shown in FIG. 4, an exemplary detector module 12 has an electrical plug (not shown), plugged into a power supply outlet 90, a single outlet 24 for the powered entrance barrier opener, and wireless signal receiver 28. The wireless signal receiver may receive signals from a powered entrance barrier position sensor (not shown). The detector module also comprises an output signal feature 70, such as a wireless signal generator to communicate with a control unit of a home or secondary alarm system. In addition, the detector module comprises four interface features 43 that can receive or send signals as required. Interface features or ports may be configured to couple with a powered entrance barrier positioning sensor, with a powered entrance barrier opener such as a back-up battery, home security system, a smart-home system and the like. In an exemplary embodiment, the powered entrance barrier alarm system is coupled with a smart-home system, whereby a homeowner can view the current status of the powered entrance barrier and powered entrance barrier opener and can control the function of the powered entrance barrier opener and/or the powered entrance barrier alarm system. A person may be able to open and close the powered entrance barrier remotely, such as by through a cellular phone for example. A person may be able to disable opening of the powered entrance barrier completely or sound the powered entrance barrier alarm from a remote device. In addition, a person may want to change the security settings of the powered entrance barrier system, such as the delay time before alarming or an all alarm setting, whereby the powered entrance barrier alarm system will alarm if the powered entrance barrier is opened under any circumstances. As shown in FIG. 4, a powered entrance barrier alarm system may be completely wireless, having a signal receiver for the powered entrance barrier position sensor and a output signal feature for communication with an auxiliary security system.

As shown in FIG. 5, an exemplary garage door positioning sensor 16 comprises a position sensor 60 and a door locator 62 coupled to the garage door 11. When the garage door 11 opens and moves along the rail, the door locator will move out of sensing range from the position sensor thereby activating a signal. The position sensor is configured with a wireless signal transmitter 66.

As shown in FIG. 6A, an exemplary garage door positioning sensor 16 comprises a light transmitter 68 and a light receiver 67. The garage door positioning sensor 16 is configured just over the garage door and when the door opens, it breaks the light beam, thereby triggering a signal to be sent to the detector module. FIG. 6B shows the exemplary light emitting garage door positioning sensor shown in FIG. 6A with the garage door in an up position. The light beam has been broken by the garage door. In another exemplary embodiment, a garage door positing sensor comprises a light transmitter and a reflector configured for placement on the garage door. A light transmitter may be configured on or near the detector module and the light beam may travel from the transmitter, to the reflector configured on the garage door, and back to a light receiver configured with or in close proximity to the light transmitter. In this way, set up of the garage door positioning sensor is quick and easy, only requiring the alignment of the light transmitter with a reflector on the garage door.

It is to be understood that any of the embodiments shown for the garage door position sensor, as shown in FIGS. 5 to 6B may be adapted for a gate, door or any other powered barrier.

FIG. 7 shows as exemplary diagram of the inputs to an exemplary detector module 12. The detector module 12 comprises a powered entrance barrier position sensor input 27 and a secondary alarm system interface 71. The detector module also has a module electrical plug and an electrical outlet for plugging in and powering a powered entrance barrier opener. The detector module also has an interface input for the powered entrance barrier battery back-up system to detect a power draw from the battery back-up system and/or to provide battery back-up power to the detector module. The detector module also has a programmable interface 46 configured to enable the detector module to be programed or otherwise set by a secondary computing system. The detector module also comprises a smart home interface input 48 that is configured to enable monitoring of the powered entrance barrier alarm system through a smart home system. A smart home system is a system that allows remote viewing and/or control of any variety of home systems including an alarm system.

FIG. 8 shows a diagram of an exemplary detector circuit 14 having a control circuit 47. The control circuit 47 receives various inputs and sends outputs to control functions of the garage door alarm system. Control circuit 47' is coupled with an alarm horn, control circuit 47" is configured to measure the threshold power parameter which may be coupled with a threshold power parameter sensor 30, and control circuit 47''' is coupled with a garage door positioning sensor 16. The garage door positioning sensor, as shown, comprises a light transmitter and a light receiver. A reflector 69 is shown configured to reflect the transmitted light. A battery back-up circuit 49 is configured with a battery back-up system of a garage door opener. An indicator light 56 is coupled on a circuit with a threshold power parameter setting feature 29. Controller 26 comprises a microprocessor that receives input from the various control circuits and provides output signals to the control circuit.

As shown in FIG. 9, the power drawn by a garage door opener peaks initially and then reduces to a relatively steady state while the door is being lifted. After the garage door is opened, typically one or more garage door opener lights remain on for a period of time to allow people to effectively see in an otherwise dark garage. The threshold power value, such as watts, or an associated current for a given voltage, is shown on FIG. 9. The threshold power parameter is about 300 Watts, or when powered by a 120V outlet, 2.5 amps. The garage door alarm system may comprise a controller, such as a microprocessor as shown in FIG. 8 that automatically sets the threshold power parameter. The controller may measure the current, for example, as the garage door is opened and determine an effective threshold value for that particular garage door opener and garage door. Heavier garage doors may require more power to lift than a lighter garage door. In addition, in an exemplary embodiment, the threshold power parameter is above the power drawn by the garage door to power the lights. If the threshold power parameter was below the power required for the lights, an intruder could cut the circuit breaker to the house and reconnect it, thereby causing the lights of the garage door opener to be activated and then the intruder could force open the garage door without the garage door alarm system detecting an intrusion.

As shown in FIG. 10, a gate 19 is configured to block the entrance to a residential property. A powered entrance barrier alarm system is coupled to the gate, whereby a position sensor 60 is configured to detect when the gate is opened and a detector module 12, coupled with the powered entrance barrier opener. The powered entrance barrier opener as shown is an electric motor that is configured to swing the gate open to allow car access to the residential driveway.

DEFINITIONS

It is to be understood that the powered entrance barrier alarm system, as described herein, may be configured for a home or any other dwelling, structure or place of business. In some cases the terms dwelling or home are used for convenience only. A powered entrance barrier as used herein may be a garage door, overhead door, gate, door or other barrier that is configured to be powered open, by a motor for example, to allow access to a dwelling or onto a premises, such as onto a residential or business property.

In addition, the term smart home system refers to a system that is configured to remotely monitor, and in some cases control, various parameters and functions of a home or other structure, such as a home or secondary security system or a garage door alarm system, as described herein.

An electrical power parameter, as used herein, refers to the electrical power being drawn by a powered entrance barrier opener and may be voltage, current or watts. In an exemplary embodiment, a threshold power parameter sensor measures the current being drawn by a garage door opener.

A secondary security system, as used herein, is an alarm system, including a home alarm system, that comprises an alarm feature including an audible, visual, and/or an alarm notification. In most cases a secondary alarm system comprises at least one other entry detector to the dwelling.

An alarm signal, as used herein, is a signal initiated by the controller of the powered entrance barrier alarm system to activate an alarm and may be a wireless signal or a signal sent through a wire that is coupled with an alarm. In an exemplary embodiment, an alarm signal is wireless and is sent by a wireless signal transmitter of the powered entrance barrier alarm system to a secondary security system that activates an alarm upon reception of the alarm signal. In another exemplary embodiment, an alarm is configured with a powered entrance barrier alarm system, as described herein, and an alarm signal is sent through a wire to the alarm.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A powered entrance barrier alarm system comprising:

a) a detector module comprising:

i) a current detector circuit directly connected with a power supply cable that leads to a powered entrance barrier opener that measures an electrical current drawn by said powered entrance barrier opener through said power supply cable;

b) an alarm system interface coupled with an alarm;

c) a powered entrance barrier position sensor input coupled with a barrier position sensor; and wherein the detector module is configured outside of the powered entrance barrier opener;

wherein the powered entrance barrier alarm system is configured to receive a signal from the barrier position sensor when said barrier position sensor detects that a powered entrance barrier is opened from a closed position; and whereby when said barrier position sensor detects that a powered entrance barrier is opened from a closed position and said detector circuit does not detect a threshold current being drawn by said powered entrance barrier opener, the powered entrance barrier alarm system activates an alarm signal through said alarm system interface.

2. The powered entrance barrier system of claim 1, wherein the powered entrance barrier is a garage door.

3. The powered entrance barrier system of claim 1, further comprising a barrier position sensor.

4. The powered entrance barrier alarm system of claim 1, where the alarm is coupled with a security alarm system.

5. The powered entrance barrier alarm system of claim 1, wherein the detector module comprises:

a) a module electrical plug;

b) a module powered entrance barrier opener electrical outlet;

wherein said detector module is configured to plug into a power supply electrical outlet;

whereby the powered entrance barrier opener is configured to plug into said module powered entrance barrier opener electrical outlet; and whereby an electrical current running from said power supply electrical outlet to said powered entrance barrier opener is measured by said current detector circuit as it passes through the detector module.

6. The powered entrance barrier alarm system of claim 5, wherein the detector module comprises an alarm.

7. The powered entrance barrier alarm system of claim 1, comprising an alarm set-point feature that is configured to control an alarm delay time.

8. The powered entrance barrier alarm system of claim 1, comprising a threshold power parameter setting feature wherein the threshold current is set by activating the powered entrance barrier opener to open the power entrance barrier, whereby the current drawn by the powered entrance barrier opener is measured and used to set the threshold current.

9. The powered entrance barrier alarm system of claim 1, wherein the barrier position sensor is a dwelling security system position sensor.

10. The powered entrance barrier alarm system of claim 1, comprising a wireless signal receiver configured to receive a wireless signal from the barrier position sensor.

11. The powered entrance barrier alarm system of claim 1, configured to be wireless comprising:

a) a wireless signal receiver configured to receive a wireless signal from a barrier position sensor; and b) a wireless signal transmitter configured to send a wireless signal to a secondary security system.

12. The powered entrance barrier alarm system of claim 1, comprising a plurality of interface features, wherein at least one interface feature is a smart-home interface feature.

13. The powered entrance barrier alarm system of claim 1, further comprising a powered entrance barrier opener battery back-up circuit, configured to measure the draw of power by a powered entrance barrier opener from a back-up battery.

14. A powered entrance barrier alarm system comprising:

a) a detector module comprising:

i) a housing;

ii) a current detector circuit directly connected with a power supply cable that leads to a powered entrance barrier opener that measures an electrical current being drawn by said powered entrance barrier opener through said power supply cable;

iii) a module electrical plug;

iv) a module powered entrance barrier opener electrical outlet;

wherein the detector module is configured outside of the powered entrance barrier opener;

whereby said detector module is configured to plug into a power supply electrical outlet;

whereby the powered entrance barrier opener is configured to plug into said module powered entrance barrier opener electrical outlet; and c) an alarm system interface coupled with an alarm;

d) a barrier position sensor input coupled with a barrier position sensor;

wherein the powered entrance barrier alarm system is configured to receive a signal from the barrier position sensor when said barrier position sensor detects that a powered entrance barrier is opened from a closed position;

whereby when said barrier position sensor input receives a signal from the barrier position sensor that a powered entrance barrier is opened from a closed position and said current detector circuit does not detect a current that is above a threshold current, the powered entrance barrier alarm system activates an alarm signal through said alarm system interface.

15. The powered entrance barrier alarm system of claim 14, wherein the current detector circuit comprises a threshold power parameter setting feature.

16. The powered entrance barrier alarm system of claim 14, wherein the alarm signal is configured to be received by a secondary security system that comprises an alarm.

17. A method of activating an alarm when a powered entrance barrier is opened without use of a powered entrance barrier opener comprising:

a) providing a powered entrance barrier alarm system comprising:

i) a detector module comprising:

a housing;

a current detector circuit directly connected with a power supply cable that leads to a powered entrance barrier opener and configured to measure a current drawn by to said powered entrance barrier opener through said power supply cable;

a module electrical plug;

a module powered entrance barrier opener electrical outlet;

whereby said detector module is configured to plug into a power supply electrical outlet;

whereby the powered entrance barrier opener is configured to plug into said module powered entrance barrier opener electrical outlet; and ii) a barrier position sensor input configured to be coupled with a barrier position sensor; and iii) an alarm interface coupled with an alarm;

b) plugging said detector module into said power supply outlet by said module electrical plug;

c) plugging said powered entrance barrier opener into said module electrical outlet;

d) interfacing the barrier position sensor input to the barrier position sensor;

measuring the electrical current drawn by said powered entrance barrier opener from said power supply electrical outlet by said detector circuit;

whereby when said barrier position sensor detects that a powered entrance barrier is opened from a closed position and said current detector circuit does not detect a threshold current level, the powered entrance barrier alarm system activates an alarm signal through said alarm system interface.

18. The method of activating an alarm when a powered entrance barrier is opened without use of a powered entrance barrier opener of claim 17, wherein the powered entrance barrier alarm system further comprises a threshold power parameter setting feature; and further comprising the step of setting the threshold power parameter setting feature to threshold current level comprises the steps of:

activating the powered entrance barrier opener to open the powered entrance barrier; and interfacing with said threshold power parameter setting feature to set a threshold current.

19. The method of activating an alarm when a powered entrance barrier is opened without use of a powered entrance barrier opener of claim 18, wherein the threshold power parameter setting feature is an on/off control feature; and wherein the step of interfacing with said threshold power parameter setting feature to set an the threshold current level includes activating said on/off control feature to an on position and then activating the powered entrance barrier opener to open the powered entrance barrier.

* * * * *